US011710607B2

(12) United States Patent
Larcher

(10) Patent No.: US 11,710,607 B2
(45) Date of Patent: Jul. 25, 2023

(54) MOBILE CONTACT-HOLDER FOR CUTOUT AND CUTOUT COMPRISING SUCH A MOBILE CONTACT-HOLDER

(71) Applicant: Schneider Electric Industries SAS, Rueil Malmaison (FR)

(72) Inventor: Patrick Larcher, Echirolles (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 0 days.

(21) Appl. No.: 17/512,976

(22) Filed: Oct. 28, 2021

(65) Prior Publication Data

US 2022/0139642 A1 May 5, 2022

(30) Foreign Application Priority Data

Nov. 3, 2020 (FR) ..... FR2011268

(51) Int. Cl.

| | |
|---|---|
| ***H01H 1/22*** | (2006.01) |
| ***H01H 1/24*** | (2006.01) |
| ***H01H 1/36*** | (2006.01) |
| ***H01H 50/56*** | (2006.01) |

(52) U.S. Cl.

CPC ..... *H01H 1/24* (2013.01); *H01H 1/221* (2013.01); *H01H 1/365* (2013.01); *H01H 50/56* (2013.01)

(58) Field of Classification Search

CPC ..... H01H 1/24; H01H 1/221; H01H 1/365; H01H 1/20; H01H 1/50; H01H 50/56; H01H 50/546; H01H 71/02; H01H 71/10

USPC .... 200/275, 243, 245, 247, 250, 252, 302.2; 335/201, 202, 16

See application file for complete search history.

(56) References Cited

U.S. PATENT DOCUMENTS

| | | | | |
|---|---|---|---|---|
| 4,454,490 | A | 6/1984 | Belbel et al. | |
| 5,635,886 | A * | 6/1997 | Pichard | H01H 73/045 335/132 |
| 6,667,448 | B2 * | 12/2003 | Schaefer | H01H 11/0012 200/243 |

(Continued)

FOREIGN PATENT DOCUMENTS

| | | |
|---|---|---|
| FR | 2483683 A1 | 12/1981 |
| FR | 2957712 A1 | 9/2011 |

OTHER PUBLICATIONS

French Search Report and Written Opinion dated Jul. 28, 2021 for corresponding French Patent Application No. FR2011268, 9 pages.

*Primary Examiner* — William A Bolton

(74) *Attorney, Agent, or Firm* — Locke Lord LLP

(57) ABSTRACT

A mobile contact-holder for a cutout includes a support in which there is formed a housing, a mobile element made of electrically conductive material mounted to slide, in a longitudinal axis of the support, in the housing of the support, an upstream electrical contact pad and a downstream electrical contact pad borne by the mobile element and a spring which exerts a return force on the mobile element. The support includes two oblong holes emerging in the housing and extending along its longitudinal axis. The mobile contact-holder also includes a guiding shaft which is fixed in translation with respect to the mobile element, which extends along an axis parallel to a transverse axis of the support and which is engaged in the oblong holes of the support. The guiding shaft engaged in the oblong holes guides the translation of the mobile element in the housing.

19 Claims, 7 Drawing Sheets

(56) References Cited

U.S. PATENT DOCUMENTS

| | | | | |
|---|---|---|---|---|
| 7,748,105 | B2 * | 7/2010 | Kinzler | H01H 71/0207 335/133 |
| 8,159,321 | B2 * | 4/2012 | Bollinger | H01H 50/546 335/106 |
| 9,911,548 | B2 * | 3/2018 | Dedina | H01H 1/18 |
| 9,941,061 | B2 * | 4/2018 | Katsube | H01H 1/502 |
| 10,109,438 | B2 * | 10/2018 | Steinbauer | H01H 15/10 |
| 2003/0000814 | A1 * | 1/2003 | McGill | H01H 50/546 200/16 R |
| 2014/0262708 | A1 * | 9/2014 | Lauraire | H01H 1/2016 200/243 |
| 2015/0008106 | A1 * | 1/2015 | Spies | H01H 1/06 200/252 |
| 2020/0279708 | A1 | 9/2020 | Ito | |

* cited by examiner

MOBILE CONTACT-HOLDER FOR CUTOUT AND CUTOUT COMPRISING SUCH A MOBILE CONTACT-HOLDER

TECHNICAL FIELD

The present invention relates to a mobile contact-holder for a cutout and a cutout comprising such a mobile contact-holder.

BACKGROUND

In the field of electrical switchgear, it is known practice to use a cutout in order to break a current line. Such a cutout comprises a casing which comprises fixed electrical contacts and mobile electrical contacts, the latter being borne by a mobile-contact holder in the casing. Such a mobile contact-holder generally comprises a support made of insulating material and a conductive metal piece bearing the mobile electrical contacts, called "mobile element" or "mobile contact". This mobile element can generally slide on the support in order to maintain a satisfactory contact pressure with the fixed electrical contacts. Now, the sliding of such a mobile element presents the drawback of degrading the support by friction, which results in the movement of the mobile element being hampered or blocked, and reduces the life thereof.

SUMMARY

It is therefore these drawbacks that the invention more particularly sets out to remedy by proposing a mobile contact-holder of increased durability.

To this end, the invention relates to a mobile contact-holder for a cutout comprising:

- a support in which there is formed a housing;
- a mobile element made of electrically conductive material mounted to slide, on a longitudinal axis of the support, in the housing of the support;
- an upstream electrical contact pad and a downstream electrical contact pad borne by the mobile element; and
- a spring exerting a return force on the mobile element.

According to the invention:

- the support also comprises two oblong holes emerging in the housing and extending along its longitudinal axis;
- the mobile contact-holder also comprises a guiding shaft which is fixed in translation with respect to the mobile element, which extends along an axis parallel to a transverse axis of the support and which is engaged in the oblong holes of the support; and
- the guiding shaft engaged in the oblong holes guides the translation of the mobile element in the housing.

By virtue of the invention, it is possible to use a mobile contact-holder in which the movement of the mobile element is effectively guided without degrading the support.

According to advantageous but non-mandatory aspects, such a mobile contact-holder for a cutout can incorporate one or more of the following features: taken alone or in any technically admissible combination:

- The mobile element is kept assembled on the support by the guiding shaft and by two slip surfaces of the mobile element in contact with two lateral faces of the housing of the support.
- The mobile element is mobile in rotation, with respect to the support, about a main axis of the guiding shaft.
- The mobile contact-holder comprises a clevis positioned in an internal volume of the mobile element, the guiding shaft being positioned through openings of the clevis and the clevis being equipped with means for retaining an end of the spring; the mobile contact-holder comprises a balancing leaf positioned between the clevis and the mobile element and inserted between the guiding shaft and the mobile element, the balancing leaf being mobile in rotation about the main axis and the guiding shaft; and
- the rotation of the balancing leaf about the main axis of the guiding shaft allows the rotation of the mobile element about the main axis of the guiding shaft.
- The mobile element comprises two lateral walls and a contact wall defining the internal volume of the mobile element, each lateral wall comprising a notch in which the guiding shaft is mounted;
- the balancing leaf bears, on the one hand, at its ends against the contact wall of the mobile element and, on the other hand, at its centre against the guiding shaft; and the bearing pressure of the two ends of the balancing leaf on the contact wall of the mobile element is balanced.
- The guiding shaft is produced in a thermosetting polymer material and, preferably, the support is produced in a thermosetting polymer material.

According to another aspect, the invention relates also to a cutout intended to be inserted into an electrical circuit comprising:

- a casing;
- a fixed upstream electrical contact pad and a fixed downstream electrical contact pad, fixed in the housing; and
- a mobile contact-holder comprising a spring, a mobile element, an upstream electrical contact pad borne by the mobile element and a downstream electrical contact pad borne by the mobile element, the mobile contact-holder being mobile in the casing between a position of closure of the electrical circuit in which the upstream contact pad of the mobile element bears against the fixed upstream contact pad, wherein the downstream contact pad of the mobile element bears against the fixed downstream contact pad and wherein a spring exerts a contact pressure between the electrical contact pads of the mobile contact-holder and the electrical contacts of the casing, and a position of opening of the electrical circuit in which the electrical contact pads of the mobile element are separated from the fixed electrical contact pads. According to the invention, the mobile contact-holder is as mentioned above.

According to advantageous but non-mandatory aspects, such a cutout can incorporate one or more of the following features, taken alone or in any technically admissible combination:

- The casing comprises two oblong housings for guiding the guiding shaft.
- The support of the mobile contact-holder masks the housings of the casing.
- Guiding zones for the mobile element with respect to the support are formed outside of the housing of the mobile contact-holder and/or guiding zones for the mobile contact-holder with respect to the casing are formed outside of the mobile contact-holder.
- The mobile element is mobile in rotation about the main axis of the guiding shaft and, in position of closure of the electrical circuit, the contact pressure of the upstream electrical contact pad of the mobile contact-holder on the fixed upstream electrical contact pad, on the one hand, and the contact pressure of the downstream electrical contact pad on the fixed downstream electrical contact pad, on the other hand, are balanced by the rotation of the mobile element about the guiding shaft.

BRIEF DESCRIPTION OF THE DRAWINGS

The invention will be better understood and other advantages thereof will become more clearly apparent in light of the following description of an embodiment of a mobile contact-holder and of a cutout, given purely by way of example and with reference to the attached drawings in which.

DETAILED DESCRIPTION

Figure 1:
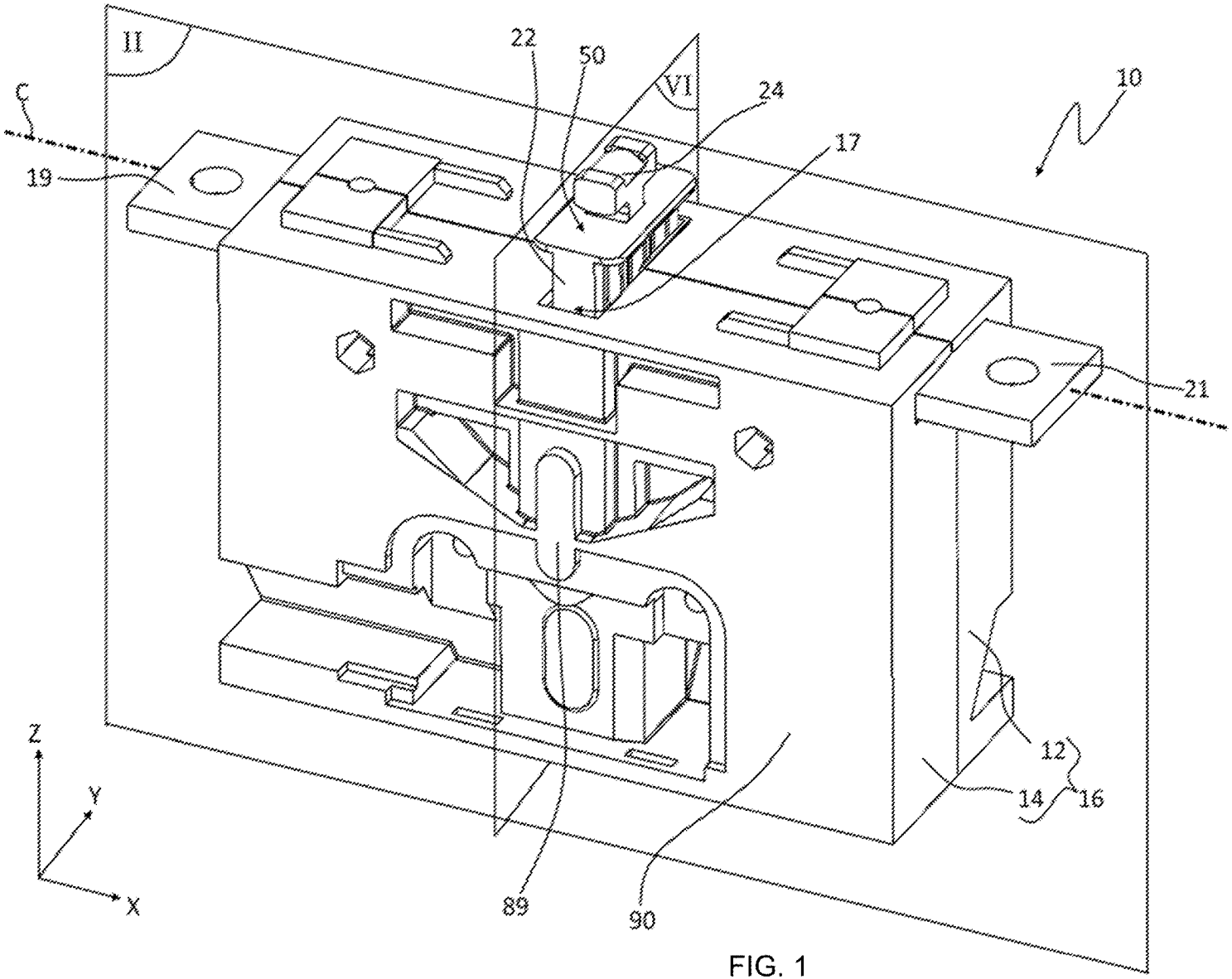
FIG. 1 is a perspective view of a cutout according to the invention.
Figure 2:
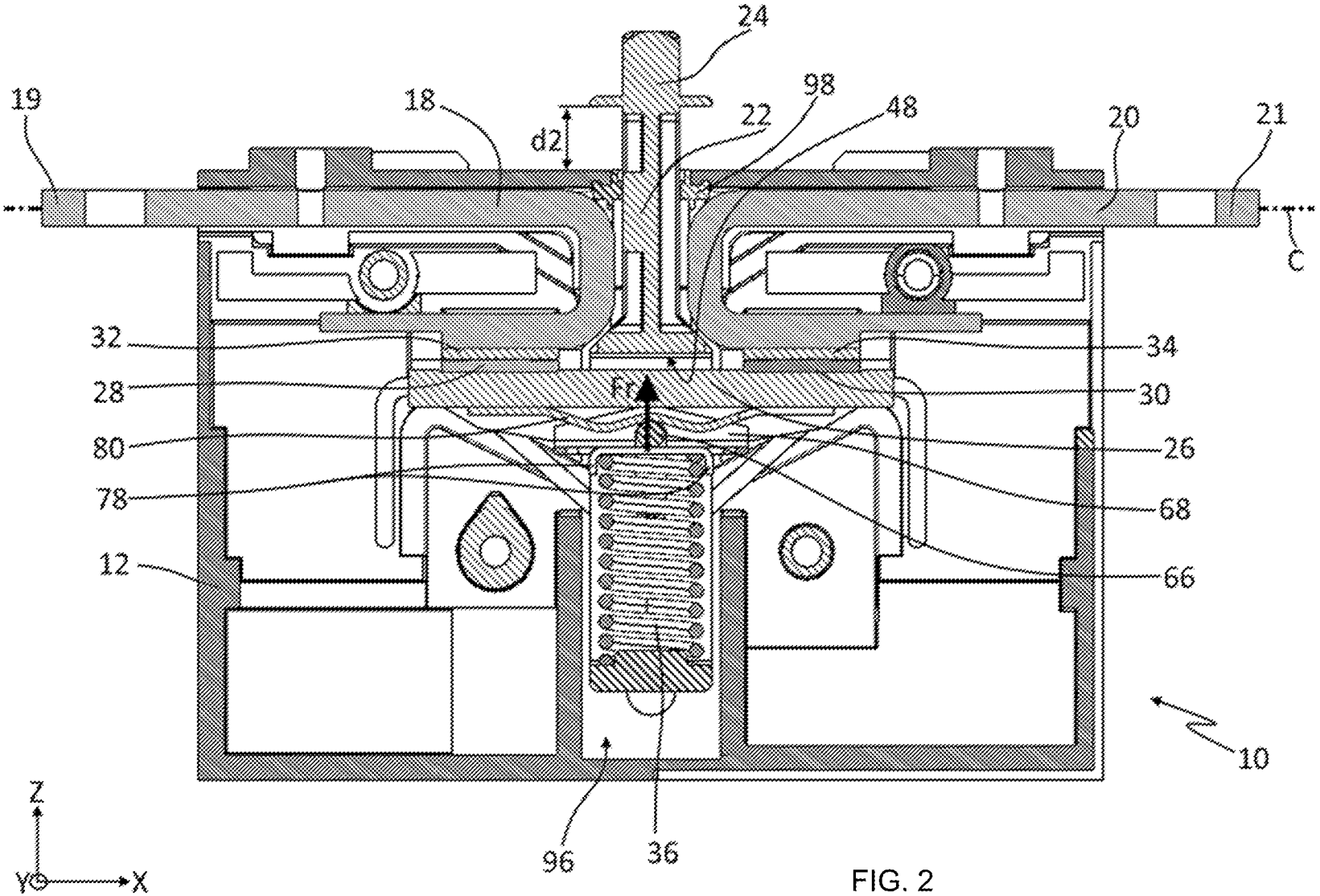
FIG. 2 is a longitudinal cross-section of the cutout of FIG. 1 on the plane II, represented in a first configuration.
Figure 3:
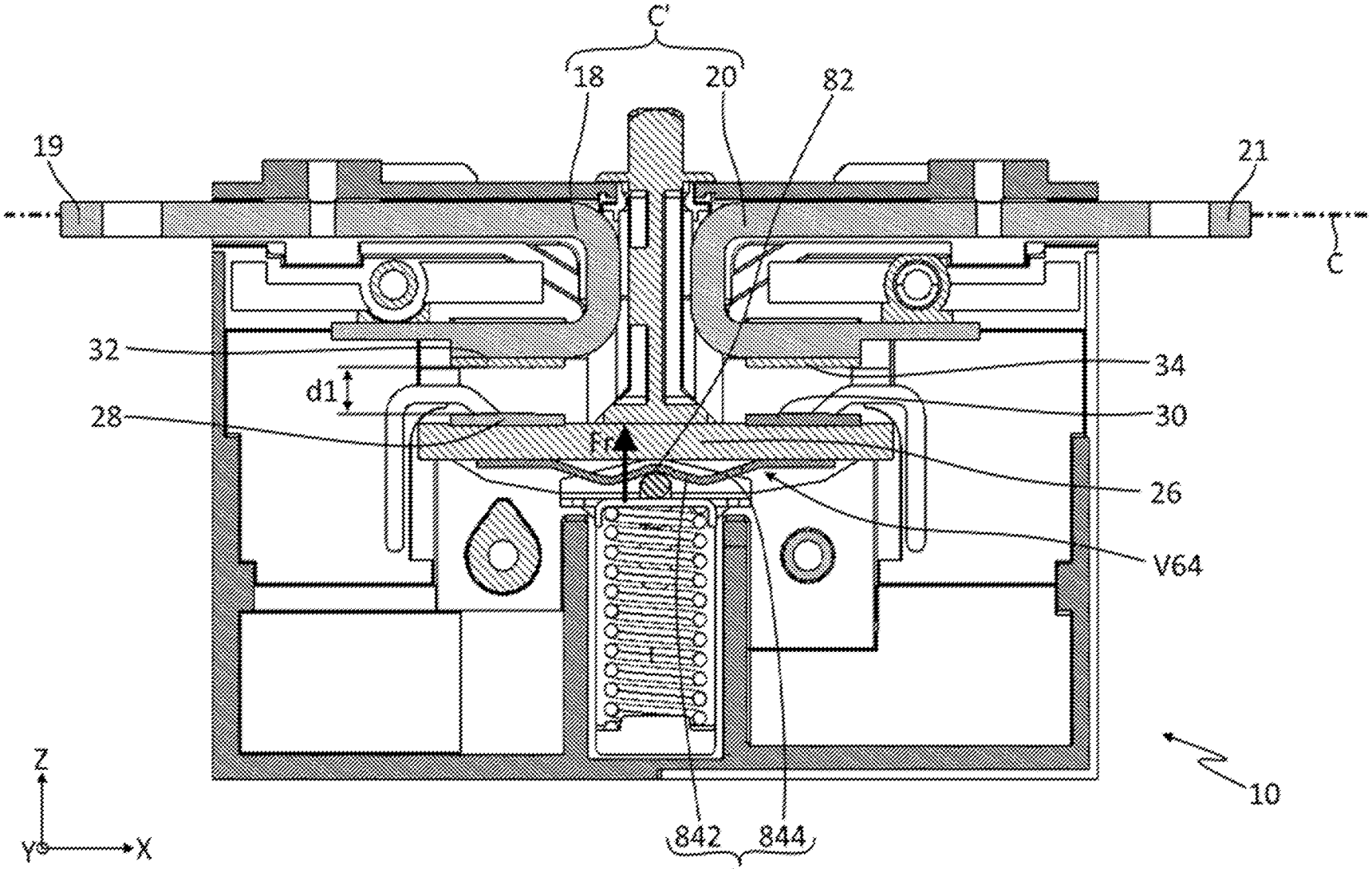
FIG. 3 is a longitudinal cross-section of the cutout of FIG. 1 on the plane II, represented in a second configuration.

A cutout 10 is represented in FIGS. 1 to 3. This cutout is intended to be incorporated in an electrical circuit C represented by an axis line in these figures. The cutout 10 makes it possible to establish or interrupt the passage of a current in this electrical circuit C. In practice, the cutout 10 is, for example, incorporated in a contactor.

The cutout 10 comprises two half-shells 12 and 14 made of insulating material that together form a casing 16, an upstream conductive strip 18, a downstream conductive strip 20 and a mobile contact-holder 22 positioned partly in the casing 16 and partly outside of the casing 16.

The conductive strips 18 and 20, which are for example made of copper, constitute portions of the electrical circuit C when the cutout 10 is incorporated in this circuit to which it is connected by terminals 19 and 21 respectively formed by ends of the strips 18 and 20. C' is used to denote the part of electrical circuit C formed by the conductive strips 18 and 20 inside the casing 16.

A longitudinal axis X of the cutout 10 is defined as being the axis of greatest dimension of the casing 16, a transverse axis Y is defined as being the axis of smallest dimension of the casing 16 and at right angles to the axis X and an axis Z is defined as being the third axis of an orthogonal reference frame including the axes X and Y. Each half-shell 12 and 14 extends mainly in the plane formed by the axes X and Z.

The casing 16 comprises an opening 17 formed on a face of the casing parallel to the plane formed by the axes X and Y. The opening 17 is partially formed on the half-shell 12 and is partially formed on the half-shell 14.

The mobile contact-holder 22 is mobile between a position of closure of the electrical circuit, that is to say a position in which the cutout 10 makes it possible to establish the passage of a current in the electrical circuit C, and a position of opening of the electrical circuit, that is to say a position in which the cutout makes it possible to interrupt the passage of a current in the electrical circuit.

The movement of the mobile contact-holder 22 is a translation which takes place along the axis Z, which is parallel to the greatest dimension of the mobile contact-holder 22 and which therefore forms a longitudinal axis for this element 22.

The movement of the mobile contact-holder 22 between the position of closure and the position of opening is driven by an actuator that is not represented, external to the cutout 10 and that is known per se. This actuator is, for example, an electromagnetic actuator comprising an electromagnet which, when it is supplied with electricity, switches over the contact-holder to the position of closure of the electrical circuit and a spring, not represented, which switches over the contact-holder to the position of opening of the electrical circuit when the electromagnet is not supplied with electricity. This actuator is linked mechanically to a maneuvering member 24 for maneuvering the mobile contact-holder 22, for example by latch mechanism.

The mobile contact-holder 22 is therefore mainly positioned inside the casing 16 but its end comprising the maneuvering member 24 is positioned outside of the casing 16. Thus, the mobile contact-holder 22 passes through the opening 17.

FIG. 2 shows the mobile contact-holder 22 in the cutout 10 in position of closure of the electrical circuit C, namely of closure of its portion C'. In this position, the upstream conductive strip 18 and the downstream conductive strip 20 are electrically linked via the mobile contact-holder 22. To allow this electrical link, the mobile contact-holder comprises a mobile element 26 made from an electrically conductive material, preferably copper.

In the embodiment detailed in the figures, this mobile element 26 is of elongate form and extends mainly along the axis X. It bears, at a first end, a mobile upstream electrical contact pad 28 and it bears, at a second end opposite the first end, a mobile downstream electrical contact pad 30.

Furthermore, the upstream conductive strip 18 bears a fixed upstream electrical contact pad 32 and the downstream conductive strip 20 bears a fixed downstream electrical contact pad 34.

The fixed electrical contact pads 32 and 34, and the mobile electrical contact pads 28 and 30 are made from an electrically conductive material, preferably silver.

In position of closure of the portion C' of the electrical circuit, the mobile contact-holder 22 is positioned in the casing 16 such that the upstream electrical contact pads 28 and 32 are in contact and the downstream electrical contact pads 30 and 34 are in contact. Thus, the mobile element 26 electrically closes the electrical circuit by linking the upstream conductive strip 18 to the downstream conductive strip 20, which makes it possible to establish the passage of an electrical current. This corresponds to the configuration of the cutout 10 represented in FIG. 2.

FIG. 3 shows the mobile contact-holder 22 in the position of opening of the electrical circuit. In this position, the fixed and mobile contact pads are not in contact and the upstream conductive strip 18 is not therefore linked to the downstream conductive strip 20, which allows the passage of an electrical current to be interrupted.

In a position of opening of the electrical circuit, the mobile contact pads 28 and 30 and the fixed contact pads 32 and 34 are separated by a distance d1, measured along the axis Z and visible in FIG. 3.

Between the position of opening of the electrical circuit C and the position of closure of this electrical circuit, the mobile contact-holder 22 is displaced by a distance d2, set and imposed by the actuator which drives the maneuvering member 24. In order to increase the reliability of the operation of the cutout 10 and guarantee the good electrical contact between the mobile contact pads and the fixed contact pads, the distance d2 is greater than the distance d1, preferably strictly greater than this distance.

To avoid degradation of the actuator or of the cutout 10 when the mobile contact pads enter into contact with the fixed contact pads, the mobile element 26 is mobile in translation along the axis Z with respect to the rest of the mobile contact-holder 22. Thus, during the transition from the position of opening to the position of closure of the circuit, when the actuator has displaced the mobile contact-holder by a distance d1, the mobile element 26 becomes immobile with respect to the casing 16 and becomes mobile with respect to the mobile contact-holder 22. The mobile contact-holder 22 then continues its displacement until it has covered a total travel equal to the distance d2.

The mobility of the mobile element 26 with respect to the rest of the mobile contact-holder 22 therefore makes it possible to increase the reliability and simplify the operation of the cutout 10, the displacement imposed by the actuator being able to be less precise than in the case of a mobile element 26 that is fixed with respect to the rest of the mobile contact-holder 22.

The mobile contact-holder 22 also comprises a spring 36 which exerts a return force Fr on the mobile element 26 that is directed along the axis Z and which is transmitted by the latter to the mobile electrical contact pads 28 and 30. Thus, in position of closure of the electrical circuit C, the mobile electrical contact pads 28 and 30 each exert a contact pressure on the fixed electrical contact pads 32 and 34. This contact pressure promotes the passage of an electrical current by allowing a better electrical connection between the pads. In position of opening of the electrical circuit, the return force Fr displaces the mobile element to a stable position.

Thus, during the switchover from a first position of the electrical circuit to a second position of the electrical circuit, two main movements occur:

- a translation of the mobile contact-holder 22 with respect to the casing 16; and
- a translation of the mobile element 26 with respect to the rest of the mobile contact-holder 22.

In practice, the cutout 10 is configured to perform, in the course of its lifetime, between 100 000 and 1 million electrical manoeuvres, that is to say switchovers between a state of circulation of a current in the electrical circuit and a state of interruption of the circulation of a current in the electrical circuit, and between 1 million and 10 million mechanical manoeuvres, that is to say of switchover between the position of closure of the electrical circuit and the position of opening of the electrical circuit, independently of the presence of an electrical current.

This high number of manoeuvres leads to a possibility of degradation of the mobile and fixed electrical contact pads. In practice, there are several causes of this degradation:

- the repeated friction of the mobile electrical contact pads on the fixed electrical contact pads leads to a mechanical wear, that is to say an abrasion, of these pads,
- the closure or the opening of the electrical circuit when this circuit is supplied with electricity leads to the formation of electrical arcs which can locally melt the electrical contact pads, which provokes the detachment of droplets of molten pad material and the spattering thereof in the casing 16. These electrical arcs are caused by the high-intensity electrical currents circulating in the electrical circuit, generally greater than 150 amperes and potentially ranging up to 1000 amperes. As an example, the electrical arcs generated upon the closure of the electrical circuit can have an intensity of approximately six times higher than the intensity of the electrical power supply current.

The fixed and mobile electrical contact pads are configured to have a sufficient thickness for these degradations not to prevent their operation, thus forming a wear guard. When they are new, the two fixed electrical contact pads on the one hand and the two mobile electrical contact pads on the other hand have surfaces facing one another which are contained in two planes parallel to the plane formed by the axes X and Y.

Figure 4:
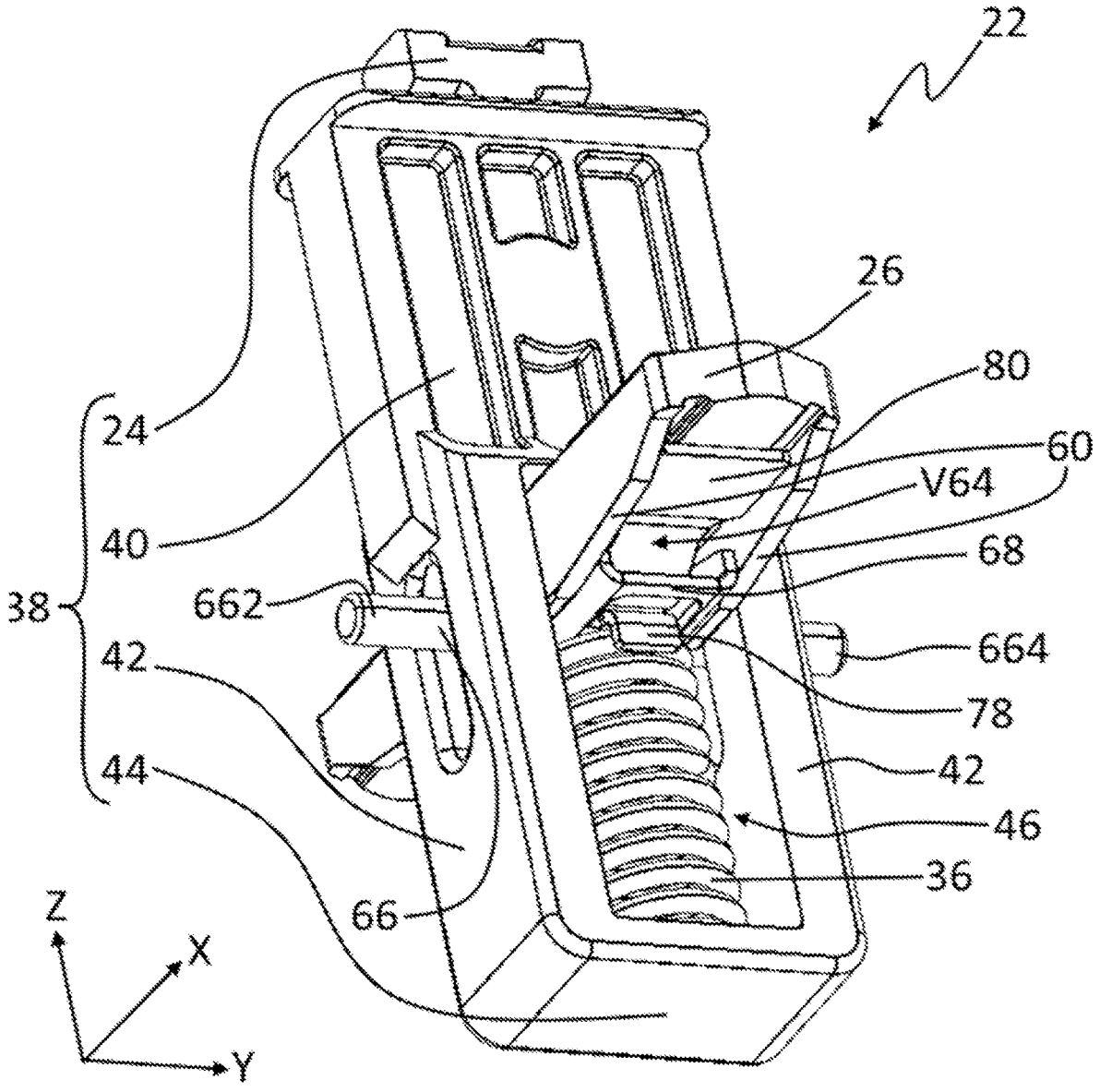
FIG. 4 is a perspective view of a mobile contact-holder of the cutout of FIGS. 1 to 3, this mobile contact-holder being in accordance with the invention.
Figure 5:
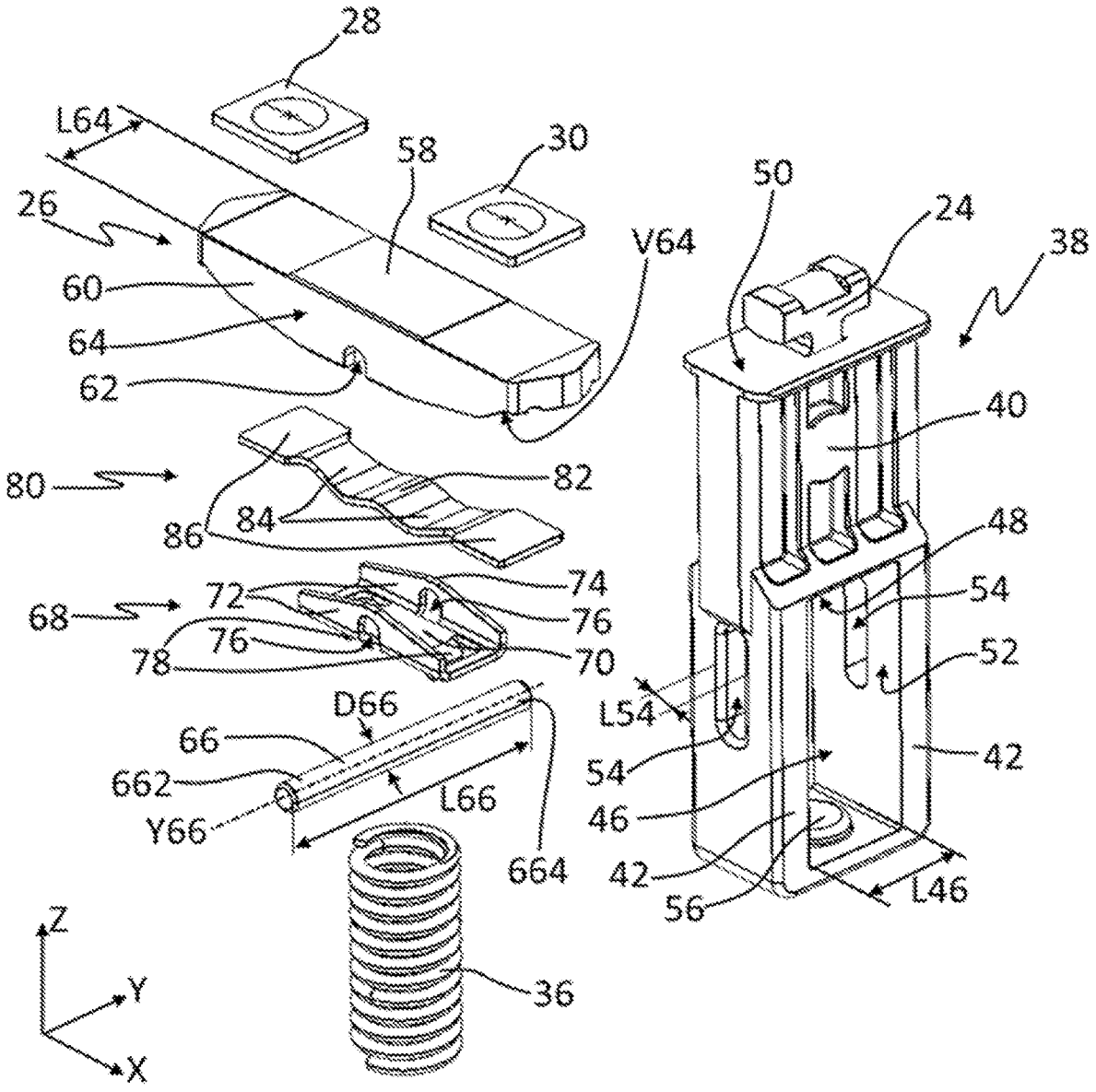
FIG. 5 is an exploded perspective view of the mobile contact-holder of FIG. 4.

As can be seen in FIGS. 4 and 5, the mobile contact-holder 22 comprises a support 38 which extends primarily on the axis Z, which corresponds to the fact that the axis Z is a longitudinal axis for the mobile contact-holder 22. This support 38 is monoblock and comprises a main body 40 which bears the maneuvering member 24, two legs 42 which extend facing one another from the main body 40 along the axis Z, opposite the maneuvering member 24, and a base 44 which links the two legs 42 at their ends opposite the main body 40. Each leg 42 extends widthwise on the axis Z over the entire width of the support 38.

The support 38 defines a housing 46 between the main body 40, the legs 42 and the base 44. The housing 46 passes right through the support 38 on the axis X.

"Inner face", denoted 48, designates the face of the main body 40 which defines the housing 46 and "outer face", denoted 50, designates the face of the main body 40 opposite the inner face and which, among other things, bears the maneuvering member 24. The inner face 48 and the outer face 50 are parallel to the plane formed by the axes X and Y.

"Lateral face", denoted 52, designates the face of each leg 42 which defines the housing 46. The lateral faces of the two legs are parallel to the plane formed by the axes X and Z.

"L46" denotes the width of the housing 46, measured on the axis X and which corresponds to the distance between the two lateral faces 52.

The housing 46 is therefore delimited by the faces 48 and 52 and by the base 44.

Each leg 42 comprises an oblong hole 54 extending along the axis Z and passing right through the leg on the axis Y. Thus, the oblong hole 54 of each leg emerges in the housing 46. The two oblong holes 54 face one another, are aligned on the axis Y and have, preferably, the same geometry. L54 denotes the width of an oblong hole measured parallel to the axis X.

The base 44 comprises a retaining pin 56 which extends on the axis Z in the housing 46.

The mobile element 26 of the mobile contact-holder 22 comprises a contact wall 58 which extends primarily on the axis X in the plane formed by the axes X and Y and two lateral walls 60, which extend opposite one another at right angles to the contact wall 58. In each lateral wall 60, there is formed a notch 68 and "slip surface", denoted 64, designates the outer face of each lateral wall 60, that is to say the face of this lateral wall directed opposite the other lateral wall.

"L64" denotes the width of the mobile element 26, measured on the axis Y and which corresponds to the distance between the two slip surfaces.

"V64" denotes the open volume defined by the contact wall 58 and the lateral walls 60 of the mobile element 26.

The upstream mobile electrical contact pad 28 and the downstream mobile electrical contact pad 30 are each borne at one end of the contact wall 58 of the mobile element 26, on the face of the contact wall opposite the lateral walls 60. The mobile contact pads 28 and 30 form part of the mobile element 26.

The mobile contact-holder 22 also comprises a guiding shaft 66. The guiding shaft 66 is a cylinder extending, in the mounted configuration of the cutout, along a main axis Y66 parallel to the axis Y, of small diameter with respect to its length. It is mounted on the mobile element 26 by running in the notches 62 of the lateral walls 60. The size of the notches 62 is configured for the guiding shaft 66 to be tightly fitted in the notches.

In a variant of the invention that is not represented, the notches 62 are replaced by cylindrical holes formed in the lateral walls 60. The diameter of these holes is configured for the guiding shaft 66 to be tightly fitted in these holes.

"D66" denotes the diameter of the guiding shaft 66.

The mobile element 26 is mounted in the housing 46 in such a way that the guiding shaft 66 passes through the two oblong holes 54 of the lateral faces 52 and in such a way that the contact wall 58 of the mobile element is directed towards the inner face 48 of the main body 40. Furthermore, the diameter D66 of the guiding shaft 66 is substantially equal to the width L54 of the oblong holes 54, operating play apart. Thus, by being engaged in the oblong holes, the guiding shaft is guided accurately by the latter, in translation on the axis Z. Furthermore, the width L64 of the mobile element 26 is substantially equal to the width L46 of the housing, operating play apart, such that the slip surfaces 64 of the mobile element are in contact with the lateral faces 52 of the housing 46. Nevertheless, the fact that the mobile element is of elongate form and therefore of small height allows for a slight rotation of the mobile element 26 about an axis parallel to the axis X passing through the centre of the guiding shaft 66.

Thus, when the mobile element 26 is mounted in the housing 46, it is mobile only

- in translation on the axis Z with respect to the support 38, this translation being guided by the slip of the guiding shaft 66 in the oblong holes 54,
- in rotation about the axis Y66 of the guiding shaft, and
- in rotation about an axis parallel to the axis X passing through the centre of the guiding shaft 66.

In these movements, the slip surfaces 64 of the mobile element slip against the lateral faces 52 of the housing 46 and the guiding shaft slips against the edges of the oblong holes 54. The amplitude of the rotation about the axis Y66 of the mobile element is between +10 and −10 degrees, preferably between +5 and −5 degrees, about a position in which the contact wall 58 is parallel to the plane formed by the axes X and Y. The amplitude of the rotation of the mobile element about the axis parallel to the axis X passing through the centre of the guiding shaft 66 is between +5 and −5 degrees.

The mobile contact-holder 22 also comprises a clevis 68. The clevis 68 comprises a bearing wall 70 parallel to the plane formed by the axes X and Y and two lateral walls 72 which extend from the bearing wall 70 at right angles to this wall, that is to say on the axis Z.

Each lateral wall 72 has a triangular form, so as to form a point 74.

Each lateral wall 72 also comprises a through opening 76 configured to allow the passage of the guiding shaft through the clevis 68. The openings 76 extend in the lateral walls 72 to the bearing wall 70, such that the guiding shaft, in position mounted on the clevis 68, is in contact with or immediate proximity to a first face of the bearing wall 70, this first face being visible in FIG. 5.

The clevis 68 also comprises two hooks 78 which extend from a second face of the bearing wall 70 opposite the first face, so as to be separated from the bearing wall 70.

In the mounted configuration of the mobile contact-holder 22, the clevis 68 is situated in the volume V64 of the mobile element 26, such that the points 74 are directed towards the contact wall 58 of the mobile element and the hooks 78 are directed towards the base 44. The guiding shaft 66 passes through the clevis 68 while being mounted in the notches 62 of the mobile element. The triangular form of the lateral walls 72 makes it possible to avoid any contact between the lateral walls 72 and the mobile element 26 when the latter is in rotation about the axis Y66 and the lateral walls 72 define the maximum amplitude of rotation of the mobile element because, in maximum rotation, the wall 58 of the mobile element enters into contact with one of the lateral walls 72. In particular, it is possible for the point 74 of each lateral wall 72 to remain at a distance from the mobile element 26 during the rotation of the mobile element about the axis Y66.

In the example represented, the spring 36 is a helical compression spring. The spring 36 is mounted between the mobile element 26 and the base 44, such that a first of its ends surrounds the retaining pin 56, which makes it possible to position and hold this end on the base 44, and that a second of its ends is situated between the hooks 78 of the clevis 68. The second end of the spring 36 exerts the return force Fr on the bearing wall 70 of the clevis 68 which then transmits this force to the guiding shaft 68 and then to the mobile element 26.

Under the effect of the return force Fr, the mobile element 26 is displaced on the axis Z until the contact wall 58 of the mobile element enters into contact with the inner face 48 of the main body 40. This position is the stable position of the mobile element 26.

The mobile contact-holder 22 also comprises a balancing leaf 80, which is mounted between the mobile element 26 and the clevis 68, in the volume V64.

The balancing leaf 80 comprises a central part 82 from which extend two lugs 84. Each lug 84 extends obliquely with respect to the axis X and comprises two parts 842 and 844. A first part 842 moves away from the central part 82 towards the clevis 68, then a second part 844 moves away from the end of the first part towards the mobile element 26. Thus, the two lugs 84 form two bosses and the central part 82 forms a dip, as can be seen in FIGS. 2, 3 and 5 where the dip of the central part 82 is oriented downwards.

The end of the second part 844 of each lug 844 is linked to a rest 86, which is flat and parallel to the plane formed by the axes X and Y. The two rests 86 form the two ends of the balancing leaf 80 and are, in the mounted configuration of the mobile contact-holder 22, in contact with the contact wall 58 of the mobile element 26. The lugs 84 are configured so that, in mounted configuration, the central part 82 is not in contact with the contact wall 58 of the mobile element, as can be seen in FIGS. 2 and 3.

In the mounted configuration of the mobile contact-holder 22, the central part 82 and a part of the lugs 84 of the balancing leaf 80 are masked by the clevis 68 and by the mobile element 26. They are configured to not to be in contact with the clevis 68.

The central part 82 of the balancing leaf 80 is in contact with the guiding shaft, such that the guiding shaft is positioned in the dip formed by this part 82. Thus, the balancing leaf is inserted between the mobile element 26 and the guiding shaft 66, as can be seen in FIGS. 2 and 3. The balancing leaf 80 is mobile in rotation about the axis Y66 of the guiding shaft 66 and fixed with respect to the mobile element 26. Thus, the balancing leaf 80 allows the rotation of the mobile element 26 about the axis Y66 of the guiding shaft 66.

The balancing leaf 80 makes it possible to balance the contact pressures of the mobile electrical contact pads 28 and 30 on the fixed electrical contact pads 32 and 34.

In fact, during the use of the cutout 10, the thickness of the electrical contact pads varies, because of the degradations that these pads undergo. Furthermore, this degradation is not uniform over all of the pads, which leads to an imbalance in the contact pressure between the upstream electrical contact pads and the downstream electrical contact pads if, for example, the degradation of the downstream pads is greater than the degradation of the upstream pads. The contact pressure difference between the upstream pads and the downstream pads can all stem from the deposition of droplets of molten material provoked by electrical arcs, which solidify on the pads and thus make their height vary.

In practice, this imbalance in the contact pressure will occur if the two fixed pads and/or if the two mobile pads are no longer contained in one and the same plane parallel to the plane formed by the axes X and Y.

When the contact pressures exerted on the two ends of the mobile element 26 by the upstream pads and the downstream pads are not uniform, the mobile element 26 is driven in rotation about the axis Y66 of the guiding shaft by virtue of the balancing leaf until these forces are balanced and therefore until the contact pressure between the upstream contact pads on the one hand and the contact pressure between the downstream contact pads are balanced. The balancing leaf 80 therefore acts as a spreader bar, in balancing the contact pressures of its two end rests 86 on the contact wall 58 of the mobile element.

By virtue of the assembly composed of the mobile element 26, of the guiding shaft 66, of the clevis 68 and of the balancing leaf 80, which allows a rotation of the mobile element about an axis parallel to the axis Y, the contact pressures of the electrical contact pads are always balanced, even when these pads are degraded.

The clevis 68 in addition makes it possible to assemble the mobile element 26 and the balancing leaf 80 with the guiding shaft 66 and allow the spring 36 to press against a planar and fixed surface.

The clevis 68 is made of a metallic material, preferably of copper-coated standard steel.

The balancing leaf 80 is made of a metallic material, preferably of spring steel, that is to say steel having mechanical characteristics suited to the design of a spring.

The support 38 is made of a thermosetting polymer material, preferably unsaturated polyester.

The guiding shaft 66 is made of a metallic material, preferably of treated alloy steel.

By virtue of the materials that make up the support 38 and the guiding shaft 66 which between them exhibit a low friction coefficient, the frictions of the guiding shaft in the oblong holes 54 are low. Thus, the movements of the mobile element 26 with respect to the support 38 are performed without the risk of blockage of the guiding shaft in the oblong holes. The translation of the mobile element in the housing 46 of the support 38 is therefore guided by the guiding shaft reliably and efficiently.

Figure 6:
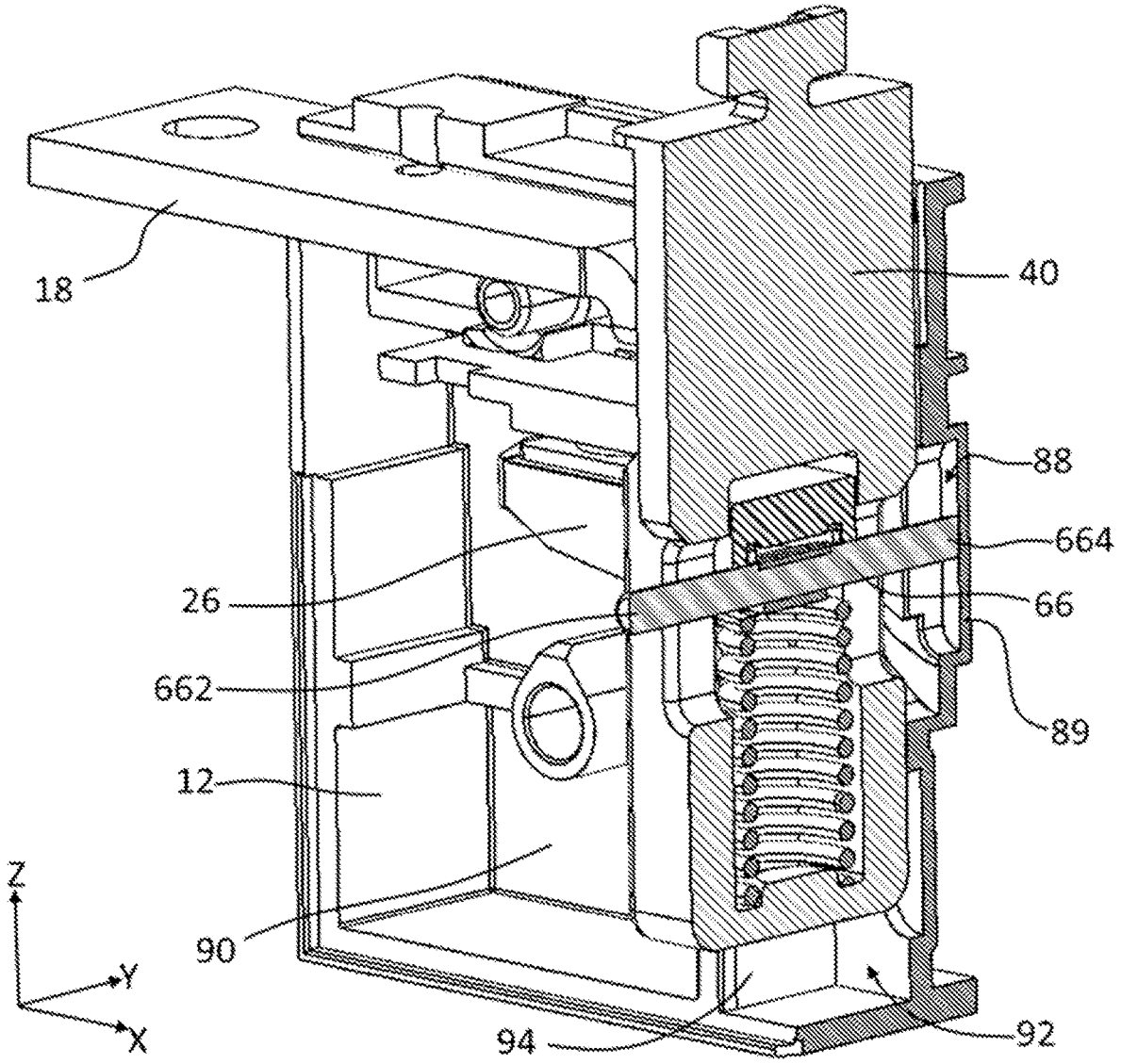
FIG. 6 is a transverse cross-section on the plane VI of FIG. 1, seen in perspective, of a part of the cutout of FIG. 1.
Figure 7:
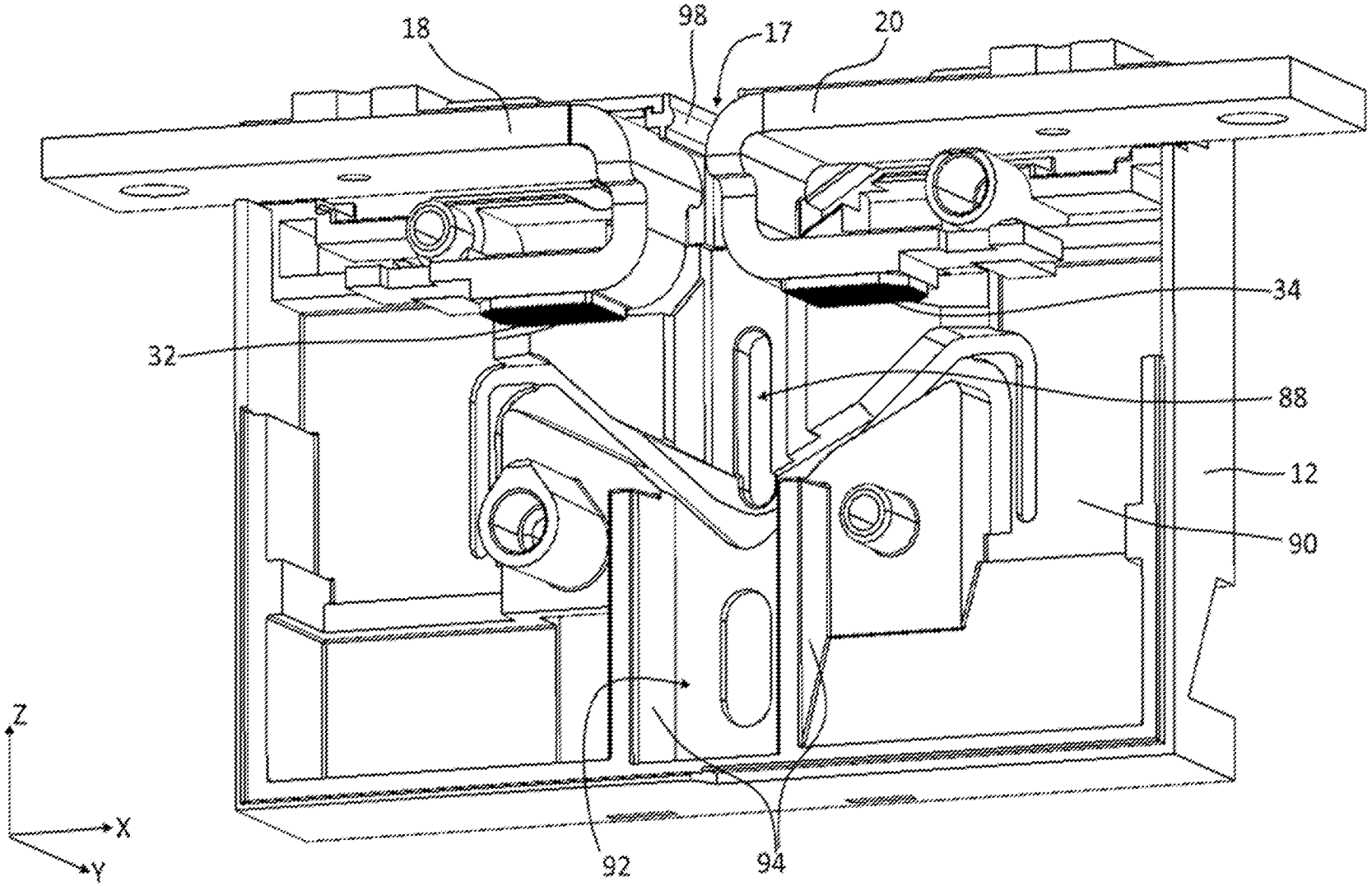
FIG. 7 is a perspective view of a part of the cutout of FIG. 1.

As can be seen in FIG. 6, which is a perspective view of the half-shell 12 and of the mobile contact-holder 22, a part of which is cut away on the plane VI, and in FIG. 7, in which only the half-shell 12 is represented without the mobile contact-holder, the half-shell 12 of the casing 16 comprises a housing 88. The half-shell 14 of the casing comprises an identical housing, not visible in the figures.

The housing 88 is formed on an inner face of the main body 90 of each half-shell, that is to say on a face directed towards the mobile contact-holder 22 in the mounted configuration of the cutout 10. This housing is a blind oblong hole which extends along the axis Z and the bottom of which is denoted 89. The bottom 89 of the housing 88 formed on the half-shell 14 is visible in FIG. 1.

The half-shell 12 also comprises a half-chamber 92, formed by two walls 94 and the main body 90. The half-shell 14 comprises an identical half-chamber, not represented but symmetrical to the half-chamber 92 with respect to the cutting plane II. When the half-shells 12 and 14 are assembled, the two half-chambers 92 together form a chamber 96.

When the mobile contact-holder 22 is mounted inside the casing 16 of the cutout 10, the main body 40 passes through the opening 17 in such a way that the maneuvering member 24 is positioned outside of the casing, the legs 42 and the base 44 are positioned in the chamber 96 of the casing 16 and the two ends 662 and 664 of the guiding shaft 66 are situated in the two oblong holes 88 of the half-shells 12 and 14.

The guiding shaft 66 is configured for its length L66 to be equal, apart from operating play, to the distance separating the bottoms 89 of the two oblong holes 88 of the half-shells, measured on the axis Y.

The translation of the support 38 of the mobile contact-holder 22 in the casing 16 is therefore guided by:

- the legs 42 and the base 44, which are held in the chamber 96;
- the main body 40, which is held in the opening 17; and
- the guiding shaft 66, the ends 662 and 664 of which are held in the housings 88.

The openings 17 comprises pads 98 which make it possible to reduce the frictions of the main body in the displacements of the mobile contact-holder 22 on the axis Z.

In practice, the support 38 of the mobile contact-holder 22 is configured to not rub against the parts of the half-shells 12 and 14 which form the chamber 96.

The translation of the mobile contact-holder 22 is therefore primarily guided by the displacement of the guiding shaft 66 in the housings 88 and of the main body 40 in the opening 17.

The guiding shaft 66 therefore makes it possible to guide both the displacement of the mobile contact-holder 22 with respect to the casing 16 and the displacement of the mobile element 26 with respect to the mobile contact-holder 22.

This dual guiding function is advantageous, because it makes it possible to easily control the relative positioning of the constituent elements of the cutout 10, and more particularly the positioning of the mobile contact-holder 22 with respect to the casing 16 and the positioning of the mobile element 26 with respect, on the one hand, to the casing 16 and, on the other hand, to the mobile contact-holder 22, because these positionings depend primarily on the positioning of the guiding shaft 66.

Notably, this dual guiding function makes it possible to simplify the functional dimensioning of the constituent elements of the cutout 10 by reducing the chains of dimensions, which allows for a better accuracy of assembly of the cutout.

By virtue of this dual guiding function of the shaft 66, the guiding zones of the mobile element 26 with respect to the support 38, that is to say the oblong holes 54, are formed outside the housing 46 and are therefore protected from pollution. Furthermore, the guiding zones of the mobile contact-holder 22 with respect to the casing 16, that is to say the housings 88, are formed outside the mobile contact-holder and are therefore protected from pollution.

Furthermore, the casing 16 is made of a thermosetting polymer material, preferably unsaturated polyester, and the pads 98 are made of a thermoplastic material with low friction coefficient. The frictions of the guiding shaft 66 against the housings 88 and of the main body 40 against the pads 98 are therefore low.

As can be seen in FIG. 6, the housings 88 are masked by the support 38, that is to say that the support 38 covers the opening of the housings 88. Thus, the housings 88 are protected from spattered droplets of molten material produced by the degradation of the mobile and fixed electrical contact pads, or from dust which could enter into the casing 16. This protection is advantageous because it makes it possible to avoid the build-up of polluting material in the housings, which could hamper the displacement of the guiding shaft 66 in the housings 88. The reliability of the operation of the cutout 10 is therefore maintained throughout its lifetime.

Furthermore, the zones exposed to pollution, for example to spattered droplets of molten material, do not contribute to the guiding of the mobile contact-holder 22 in the casing 16, which is advantageous by making it possible to control the ageing of the cutout 10.

The assembly of the mobile contact-holder 22 comprises the following steps: assembly of the pads 28 and 30 on the contact wall 58 of the mobile element 26, for example by gluing;

positioning of the clevis 68 and of the balancing leaf 80 in the volume V64 of the mobile element 26, so as to align the openings 76 of the clevis with the notches 62 of the mobile element and with the central part 82 of the balancing leaf;

positioning of the mobile element 26, of the clevis 68 and of the balancing leaf 80 in the housing 46, such that the notches 62 of the mobile element are aligned with the oblong holes 54 of the legs 42;

mounting of the guiding shaft 66 in the openings 76 of the clevis 68 and in the notches 62 of the mobile element 26, through an oblong hole 54, by a translation on the axis Y66, so as to insert the balancing leaf 80 between the guiding shaft and the mobile element 26; and positioning of the spring 36 in the housing 46, such that the spring 36 is held at the first of its ends by the retaining pin 56 and at the second of its ends by the hooks 78 of the clevis.

As a variant, the spring is positioned in the housing 46 before the step of mounting of the guiding shaft 66.

The fact that the guiding shaft 66 is tightly fitted in the notches 62 prevents it from being dismantled by slipping along the axis Y66. The guiding shaft is therefore received in the oblong holes 54 and makes it possible to keep all of the parts of the mobile contact-holder 22 mounted, such as a pin. Furthermore, the assembly of the mobile contact-holder 22 is simple and does not require specific tools. The fact that the width L64 of the mobile element 26 is substantially equal to the width L46 of the housing 46 also prevents any movement, along the axis Y, of the mobile element in the housing. The mobile element 26 is therefore kept assembled in the housing 46 of the support 38 on the one hand by the two lateral faces 52 of the housing, which block any translation on the axis Y of the mobile element, and on the other hand by the guiding shaft, which prevents the dismantling of the mobile element.

The assembly of the cutout 10 comprises the following steps:

placement of the mobile contact-holder 22 in the half-shell 12 so as to position the main body 40 through the opening 17, the legs 42 in the half-chamber 92 and a first end of the guiding shaft 66 in the housing 88; and placement of the half-shell 14 on the half-shell 12 so as to fit them together while positioning a second end of the guiding shaft 66 in the housing 88 of the half-shell 14.

The assembly of the mobile contact-holder 22 in the casing 16 is therefore simple and rapid.

In practice, the cutout 10 comprises other elements in the casing 16, necessary to its correct operation. These elements can, for example, be insulators, electric arc splitters or deflectors. These elements have not been represented or described for the purposes of simplifying the present explanation.

The most costly elements of the cutout 10 are the electrical contact pads 28, 30, 32 and 34. Their cost stems essentially from the material used, which is preferably silver. The other elements of the cutout 10 are inexpensive, notably all of the parts made of thermosetting polymer, such as the casing 16 and the support 38, which can be manufactured by moulding.

The invention claimed is:

1. A mobile contact-holder for a cutout comprising:

a support in which there is formed a housing;

a mobile element made of electrically conductive material mounted to slide, on a longitudinal axis of the support, in the housing of the support;

an upstream electrical contact pad and a downstream electrical contact pad borne by the mobile element; and a spring exerting a return force on the mobile element, wherein:

the support further comprises two oblong holes emerging in the housing and extending along a longitudinal axis of the housing;

the mobile contact-holder also comprises a guiding shaft which is fixed in translation with respect to the mobile element, and which extends along an axis parallel to a transverse axis of the support and which is engaged in the oblong holes of the support; and the guiding shaft engaged in the oblong holes guides translation of the mobile element in the housing, wherein the mobile element is mobile in rotation, with respect to the support, about a main axis of the guiding shaft, and wherein:

the mobile contact-holder comprises a clevis positioned in an internal volume of the mobile element, the guiding shaft being positioned through openings of the clevis and the clevis being equipped with means for retaining an end of the spring;

the mobile contact-holder comprises a balancing leaf positioned between the clevis and the mobile element and inserted between the guiding shaft and the mobile element, the balancing leaf being mobile in rotation about the main axis and the guiding shaft; and the rotation of the balancing leaf about the main axis of the guiding shaft allows the rotation of the mobile element about the main axis of the guiding shaft.

2. The mobile contact-holder according to claim 1, wherein the mobile element is kept assembled on the support by the guiding shaft and by two slip surfaces of the mobile element in contact with two lateral faces of the housing of the support.

3. The mobile contact-holder according to claim 1, wherein:

the mobile element comprises two lateral walls and a contact wall defining the internal volume of the mobile element, each lateral wall comprising a notch in which the guiding shaft is mounted;

the balancing leaf bears on the one hand at its ends against the contact wall of the mobile element and, on the other hand, at its centre against the guiding shaft; and the bearing pressure of the two ends of the balancing leaf on the contact wall of the mobile element is balanced.

4. The mobile contact-holder according to claim 1, wherein the guiding shaft is produced in a thermosetting polymer material and wherein the support is produced in a thermosetting polymer material.

5. A cutout intended to be inserted into an electrical circuit and comprising:

a casing;

a fixed upstream electrical contact pad and a fixed downstream electrical contact pad, fixed in the casing; and the mobile contact-holder according to claim 1, the mobile contact-holder being mobile in the casing between a position of closure of the electrical circuit in which the upstream contact pad of the mobile element is bearing against the fixed upstream contact pad, wherein the downstream contact pad of the mobile element is bearing against the fixed downstream contact pad and wherein the spring exerts a contact pressure between the electrical contact pads of the mobile contact-holder and the electrical contacts of the casing and a position of opening of the electrical circuit in which the electrical contact pads of the mobile element are separated from the fixed electrical contact pads.

6. The cutout according to claim 5, wherein the casing comprises two oblong housings for guiding the guiding shaft.

7. The cutout according to claim 6, wherein the support of the mobile contact-holder masks the housings of the casing.

8. The cutout according to claim 5, wherein guiding zones of the mobile element with respect to the support are formed outside of the housing of the mobile contact-holder and/or wherein guiding zones of the mobile contact-holder with respect to the casing are formed outside of the mobile contact-holder.

9. The cutout according to claim 5, wherein the mobile element is mobile in rotation about the main axis of the guiding shaft and wherein, in position of closure of the electrical circuit, the contact pressure of the upstream electrical contact pad of the mobile contact-holder on the fixed upstream electrical contact pad, on the one hand, and the contact pressure of the downstream electrical contact pad on the fixed downstream electrical contact pad, on the other hand, are balanced by the rotation of the mobile element about the guiding shaft.

10. A mobile contact-holder for a cutout comprising:

a support in which there is formed a housing;

a mobile element made of electrically conductive material mounted to slide, on a longitudinal axis of the support, in the housing of the support;

an upstream electrical contact pad and a downstream electrical contact pad borne by the mobile element; and a spring exerting a return force on the mobile element, wherein:

the support further comprises two oblong holes emerging in the housing and extending along a longitudinal axis of the housing;

the mobile contact-holder also comprises a guiding shaft which is fixed in translation with respect to the mobile element, and which extends along an axis parallel to a transverse axis of the support and which is engaged in the oblong holes of the support; and the guiding shaft engaged in the oblong holes guides translation of the mobile element in the housing, wherein the guiding shaft is produced in a thermosetting polymer material and wherein the support is produced in a thermosetting polymer material.

11. The mobile contact-holder according to claim 10, wherein the mobile element is kept assembled on the support by the guiding shaft and by two slip surfaces of the mobile element in contact with two lateral faces of the housing of the support.

12. The mobile contact-holder according to claim 10, wherein the mobile element is mobile in rotation, with respect to the support, about a main axis of the guiding shaft.

13. The mobile contact-holder according to claim 12, wherein:

the mobile contact-holder comprises a clevis positioned in an internal volume of the mobile element, the guiding shaft being positioned through openings of the clevis and the clevis being equipped with means for retaining an end of the spring;

the mobile contact-holder comprises a balancing leaf positioned between the clevis and the mobile element and inserted between the guiding shaft and the mobile element, the balancing leaf being mobile in rotation about the main axis and the guiding shaft; and the rotation of the balancing leaf about the main axis of the guiding shaft allows the rotation of the mobile element about the main axis of the guiding shaft.

14. The mobile contact-holder according to claim 13, wherein:

the mobile element comprises two lateral walls and a contact wall defining the internal volume of the mobile element, each lateral wall comprising a notch in which the guiding shaft is mounted;

the balancing leaf bears on the one hand at its ends against the contact wall of the mobile element and, on the other hand, at its centre against the guiding shaft; and the bearing pressure of the two ends of the balancing leaf on the contact wall of the mobile element is balanced.

15. A cutout intended to be inserted into an electrical circuit and comprising:

a casing;

a fixed upstream electrical contact pad and a fixed downstream electrical contact pad, fixed in the casing; and the mobile contact-holder according to claim 10, the mobile contact-holder being mobile in the casing between a position of closure of the electrical circuit in which the upstream contact pad of the mobile element is bearing against the fixed upstream contact pad, wherein the downstream contact pad of the mobile element is bearing against the fixed downstream contact pad and wherein the spring exerts a contact pressure between the electrical contact pads of the mobile contact-holder and the electrical contacts of the casing and a position of opening of the electrical circuit in which the electrical contact pads of the mobile element are separated from the fixed electrical contact pads.

16. The cutout according to claim 15, wherein the casing comprises two oblong housings for guiding the guiding shaft.

17. The cutout according to claim 16, wherein the support of the mobile contact-holder masks the housings of the casing.

18. The cutout according to claim 15, wherein guiding zones of the mobile element with respect to the support are formed outside of the housing of the mobile contact-holder and/or wherein guiding zones of the mobile contact-holder with respect to the casing are formed outside of the mobile contact-holder.

19. The cutout according to claim 15, wherein the mobile element is mobile in rotation about the main axis of the guiding shaft and wherein, in position of closure of the electrical circuit, the contact pressure of the upstream electrical contact pad of the mobile contact-holder on the fixed upstream electrical contact pad, on the one hand, and the contact pressure of the downstream electrical contact pad on the fixed downstream electrical contact pad, on the other hand, are balanced by the rotation of the mobile element about the guiding shaft.

* * * * *